US008326188B2

(12) United States Patent
Nishiwaki

(10) Patent No.: US 8,326,188 B2
(45) Date of Patent: Dec. 4, 2012

(54) DEVELOPER SUPPLY DEVICE

(75) Inventor: Kenjiro Nishiwaki, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 416 days.

(21) Appl. No.: 12/645,290

(22) Filed: Dec. 22, 2009

(65) Prior Publication Data

US 2010/0158577 A1 Jun. 24, 2010

(30) Foreign Application Priority Data

Dec. 22, 2008 (JP) ..... 2008-325313
Dec. 22, 2008 (JP) ..... 2008-325320
Dec. 22, 2008 (JP) ..... 2008-325322

(51) Int. Cl.
*G03G 15/08* (2006.01)

(52) U.S. Cl. ..... 399/266; 399/289

(58) Field of Classification Search ..... 399/265, 399/266, 289, 290, 291
See application file for complete search history.

(56) References Cited

U.S. PATENT DOCUMENTS

| | | | | |
|---|---|---|---|---|
| 4,598,991 | A * | 7/1986 | Hosoya et al. | 399/266 |
| 5,027,157 | A | 6/1991 | Hotomi et al. | |
| 5,142,336 | A | 8/1992 | Hotomi et al. | |
| 6,272,296 | B1 | 8/2001 | Gartstein | |
| 8,107,862 | B2 * | 1/2012 | Hattori et al. | 399/265 |
| 2003/0210928 | A1 | 11/2003 | Miyaguchi et al. | |
| 2009/0080942 | A1 * | 3/2009 | Nishiwaki et al. | 399/254 |

FOREIGN PATENT DOCUMENTS

| | | | |
|---|---|---|---|
| JP | S60-115962 | A | 6/1985 |
| JP | H01-184862 | A | 7/1989 |
| JP | H02-160266 | A | 6/1990 |
| JP | H03-12678 | A | 1/1991 |
| JP | H04-299155 | A | 10/1992 |
| JP | H06-161236 | A | 6/1994 |
| JP | H11-084862 | A | 3/1999 |
| JP | 2001-122436 | A | 5/2001 |
| JP | 2001-209246 | A | 8/2001 |
| JP | 2002-287495 | A | 10/2002 |
| JP | 2003-265982 | A | 9/2003 |
| JP | 2004-279880 | A | 10/2004 |
| JP | 2004-341311 | A | 12/2004 |
| JP | 2008-070803 | * | 3/2008 |

OTHER PUBLICATIONS

Machine translation of JP 2008-070803.*
State Intellectual Property Office of the People's Republic of China, The First Office Action for Chinese Patent Application No. 200910261182.7, mailed Sep. 30, 2011.
European Patent Office; Extended European Search Report for Patent Application No. EP09180328.8, dated Nov. 19, 2010.
Japan Patent Office, Notification of Reasons for Rejection for Patent Application No. JP2008-325313, mailed Sep. 28, 2010.

* cited by examiner

*Primary Examiner* — Walter L Lindsay, Jr.
*Assistant Examiner* — Barnabas Fekete
(74) *Attorney, Agent, or Firm* — Baker Botts L.L.P.

(57) ABSTRACT

A developer supply device carrying charged developer along a developer carrying path to a supply target, including: a carrying substrate that includes a plurality of carrying electrodes arranged along the developer carrying path and is configured to carry the developer through an electric field generated by voltage application to the plurality of carrying electrodes. The carrying substrate comprises a vertical carrying substrate provided to stand to carry the developer upward in a substantially vertical direction. The developer is supplied to the supply target around an upper end portion of the vertical carrying substrate.

17 Claims, 6 Drawing Sheets

DEVELOPER SUPPLY DEVICE

CROSS-REFERENCE TO RELATED APPLICATION

This application claims priority under 35 U.S.C. §119 from Japanese Patent Applications No. 2008-325313, filed on Dec. 22, 2008, No. 2008-325320, filed on Dec. 22, 2008, and No. 2008-325322, filed on Dec. 22, 2008. The entire subject matter of the applications is incorporated herein by reference.

BACKGROUND

1. Technical Field

Aspects of the present invention relate to a developer supply device carrying developer along a developer carrying path through an electric field to supply the developer to a supply target.

2. Related Art

Developer supply devices configured to have a plurality of carrying electrodes arranged along a developer carrying direction and to carry developer through an electric field generated by voltage application to the plurality of carrying electrodes have been widely used.

SUMMARY

In such a developer supply device, if carrying failure of the developer occurs (i.e., if a developer not properly charged is supplied to the supply target or if retention of the developer occurs in a midway point on the developer carrying path), an image formed by the developer deteriorates.

Aspects of the present invention are advantageous in that an developer supply device capable of properly carrying developer is provided.

According to an aspect of the invention, there is provided a developer supply device carrying charged developer along a developer carrying path to a supply target, comprising: a carrying substrate that includes a plurality of carrying electrodes arranged along the developer carrying path and is configured to carry the developer through an electric field generated by voltage application to the plurality of carrying electrodes. The carrying substrate comprises a vertical carrying substrate provided to stand to carry the developer upward in a substantially vertical direction. The developer is supplied to the supply target around an upper end portion of the vertical carrying substrate.

BRIEF DESCRIPTION OF THE ACCOMPANYING DRAWINGS

DETAILED DESCRIPTION

Hereafter, embodiments according to the invention will be described with reference to the accompanying drawings.

First Embodiment

Figure 1:
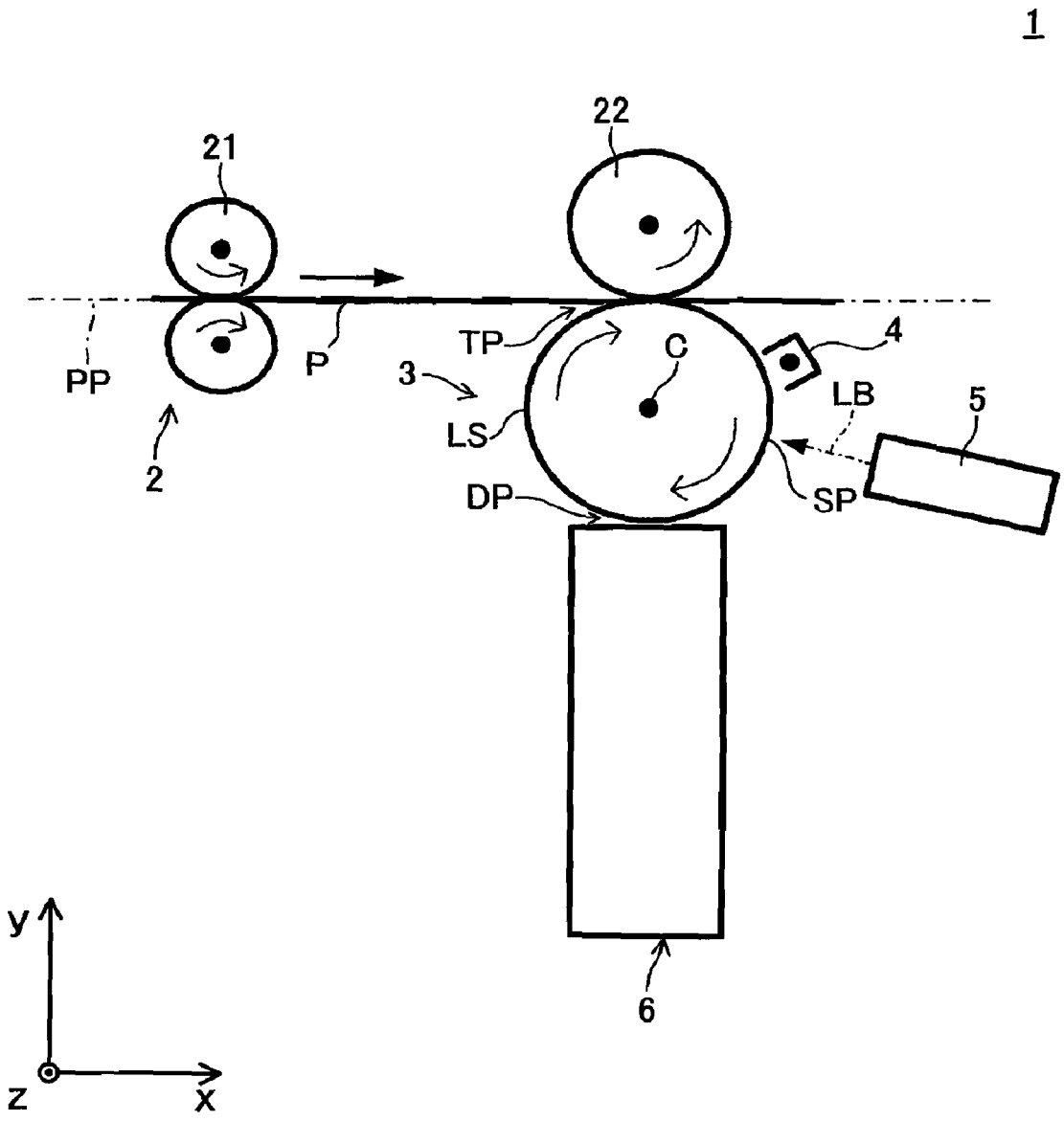
FIG. 1 is a side view illustrating a general configuration of a laser printer according to a first embodiment.

As shown in FIG. 1, a laser printer 1 according to a first embodiment includes a paper carrying mechanism 2, a photosensitive drum 3, a charger 4, a scanning unit 5 and a toner supply unit 6. On a paper supply tray (not shown) provided in the laser printer 1, a stack of sheets of paper is accommodated. The paper carrying mechanism 2 is configured to carry a sheet of paper P along a paper carrying path PP. An outer circumferential surface of the photosensitive drum 3 which is a supply target is formed to be an electrostatic latent image holding surface LS. The electrostatic latent image holding surface LS is formed as a cylindrical surface elongated in parallel with a main scanning direction (i.e., a direction of z-axis in FIG. 1). On the electrostatic latent image holding surface LS, an electrostatic latent image is formed as potential distribution, and toner T (developer) is held at portions corresponding to the electrostatic latent image.

The photosensitive drum 3 is configured to rotate in a direction indicated by an arrow in FIG. 1 (i.e., in the clockwise direction) about the center axis C extending in the main scanning direction. That is, the photosensitive drum 3 is configured such that the electrostatic latent image holding surface LS moves along an auxiliary scanning direction which is perpendicular to the main scanning direction.

The charger 4 is located to face the electrostatic latent image holding surface LS. The charger 4 is a corotron type charger or a scorotron charger, and is configured to charge uniformly the electrostatic latent image holding surface LS.

The scanning unit 5 is configured to emit a laser beam LB modulated based on image data. That is, the scanning unit 5 emits the laser beam LB which is on/off modulated in accordance with presence/absence of pixel data and which has a predetermined wavelength band. Further, the scanning unit 5 is configured to converge the laser beam LB at a scan position SP on the electrostatic latent image holding surface LS. The scan position SP is located on the downstream side in the rotational direction of the photosensitive drum 3 with respect to the charger 4.

Further, the scanning unit 5 is configured to scan the laser beam LB, at the converged position, on the electrostatic latent image holding surface LS in the main scanning direction at a constant speed, so that an electrostatic latent image is formed on the electrostatic latent image holding surface LS.

The toner supply unit 6 is located under the photosensitive drum 3 to face the photosensitive drum 3. The toner supply unit 6 is configured to supply the toner T, which is in a charged state, to the electrostatic latent image holding surface LS at a development position DP. The development position DP is a position at which the toner supply unit 6 faces the electrostatic latent image holding surface LS. The detailed configuration of the toner supply unit 6 is explained later.

Hereafter, each of the components of the laser printer 1 is explained in detail.

The paper carrying mechanism 2 includes a pair of registration rollers 21 and a transfer roller 22. The registration roller 21 is configured to send the sheet of paper P at predetermined timing toward a position between the transfer roller 22 and the photosensitive drum 3.

The transfer roller 22 is located such that the sheet of paper P is sandwiched at a transfer position TP between the transfer roller 22 and the photosensitive drum 3. Further, the transfer roller 22 is configured to be rotated in the direction indicated by an arrow in FIG. 1 (i.e., in the counterclockwise direction).

The transfer roller 22 is connected to a bias power source (not shown) so that a predetermined transfer voltage for transferring the toner adhered on the electrostatic latent image holding surface LS to the sheet of paper P is applied thereto.

Figure 2:
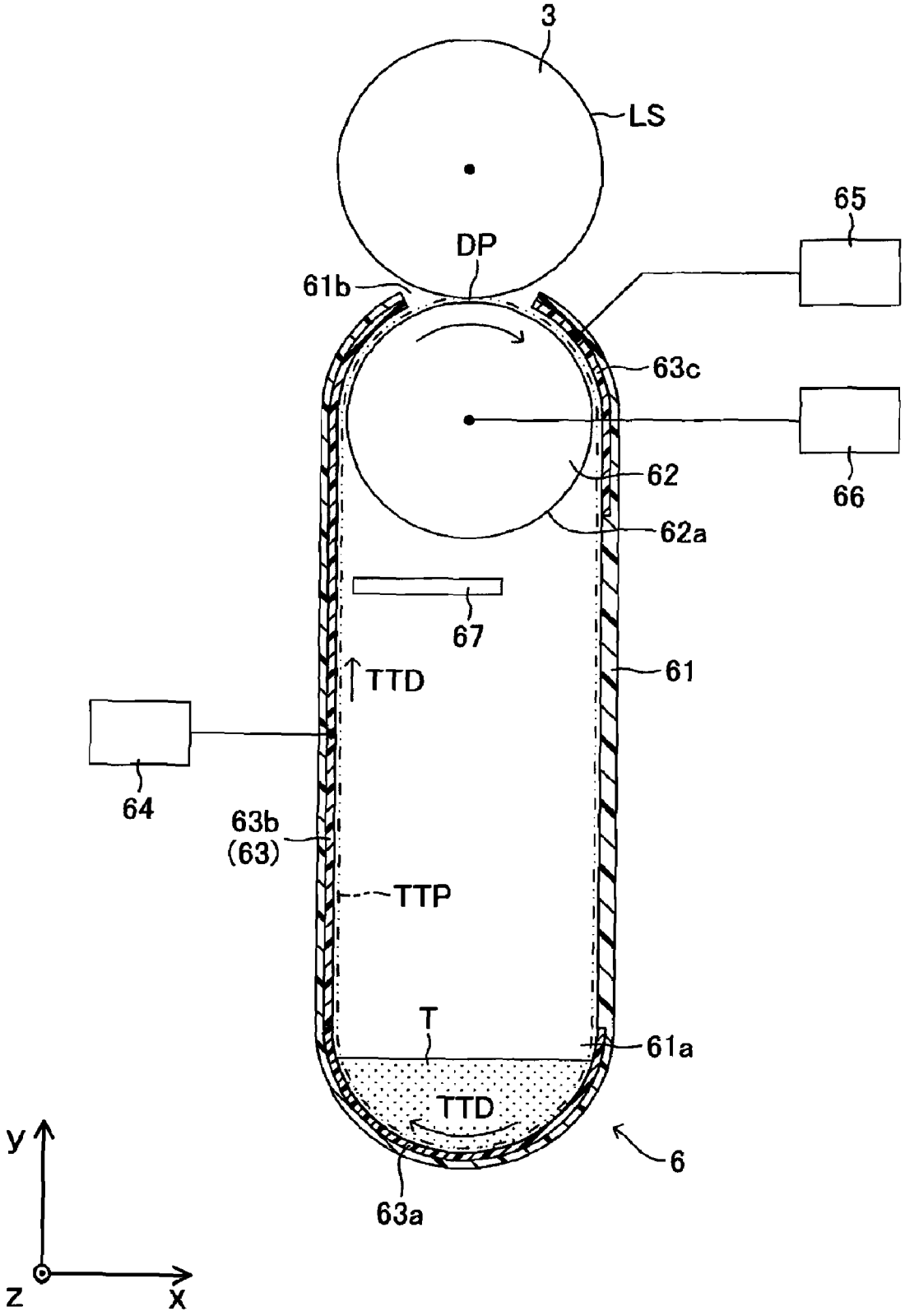
FIG. 2 is an enlarged side cross section illustrating a configuration of a toner supply unit shown in FIG. 1.

As shown in FIG. 2, the toner supply unit 6 is configured to supply the charged toner T to the photosensitive drum 3 by carrying the charged toner T through an electric field along a toner transport path TTP.

A toner box 61 serving as a casing of the toner supply unit 6 is a box type member having an elliptical shape when viewed as a side cross section, and is positioned such that the longer side thereof is in parallel with the vertical direction (i.e., the direction of y-axis). Inside the toner box 61, the toner T which is dry type powdery developer is accommodated. That is, a toner reservoir part 61*a* is formed by semicylindrical inside space formed at the lower end portion of the toner box 61. In this embodiment, the toner T has a positive electrostatic property, and is single component black toner having a nonmagnetic property. At the top of the toner box 61 (i.e., the position facing the photosensitive drum 3), an opening 61*b* is formed.

Inside the toner box 61, a development roller 62 serving as a developer holding body is accommodated. The development roller 62 is held by the toner box 61 to be rotatable. The development roller 62 is a roller-like member having a toner holding surface 62*a* which is a cylindrical circumferential surface. The development roller 62 is located to face the photosensitive drum 3 through the opening 61*b*. That is, the toner box 61 and the development roller 62 are located so that, at the development position DP, the toner holding surface 62*a* of the development roller 62 is located closely to the electrostatic latent image holding surface LS of the photosensitive drum 3 via a gap having a predetermined interval (e.g., approximately 500 μm).

Inside the toner box 61, a carrying substrate 63 is provided along the toner transport path TTP. The carrying substrate 63 is fixed on the inner wall of the toner box 61. In this embodiment, the carrying substrate 63 includes a bottom carrying substrate 63*a*, a vertical carrying substrate 63*b* and a collecting substrate 63*c*. The inner configuration of the carrying substrate 63 is explained in detail later.

The bottom carrying substrate 63*a* is located at the bottom in the inner space of the toner box 61 to from the bottom surface of the toner reservoir 61*a*. The bottom carrying substrate 63*a* is formed as a recessed curved surface which is curved to have a semicylindrical shape when viewed as a side cross section. Further, the bottom carrying substrate 63*a* is formed to smoothly connect to the lower end of the vertical carrying substrate 63*b*. The bottom carrying substrate 63*a* is connected to the lower end of the vertical carrying substrate 63*b* so that the toner T in the toner reservoir 61*a* is carried to the lower end of the vertical carrying substrate 63*b*.

The vertical carrying substrate 63*b* is formed to stand in the vertical direction so that the toner T is carried upwardly in the vertical direction. More specifically, the vertical carrying substrate 63*b* is configured to carry the toner T supplied from the bottom substrate 63*a* toward the development roller 62 and the development position DP in a toner transport direction TTD.

In this embodiment, the vertical carrying substrate 63*b* is formed such that the upper end of the vertical carrying substrate 63*b* is located at the position which is higher than the center of the development roller 62. More specifically, the upper end of the vertical carrying substrate 63*b* is located to reach the opening 61*b*. The upper end of the vertical carrying substrate 63*b* is formed to be a recessed curved surface to face the cylindrical toner holding surface 62*a* of the development roller 62 via a gap having a predetermined interval (e.g., approximately 300 μm).

The collecting substrate 63*c* is located to face the development roller 62 at the opposite position with respect to the upper end of the vertical carrying substrate 63*b* while sandwiching the development roller 62 between the collecting substrate 63*c* and the upper end of the vertical carrying substrate 63*b*. That is, the collecting substrate 63*c* is located on the downstream side in the toner transport direction TTD with respect to the opening 61*b* of the toner box 61. In this embodiment, the end part of the collecting substrate 63*c* in the toner transport direction TTD is located at the position corresponding to the position of the lower end of the development roller 62.

The collecting substrate 63*c* collects, from the development roller 62, the toner T which has not been consumed at the development position DP, and carries downwardly the collected toner T toward the toner reservoir 61*a*. More specifically, the upper part of the collecting substrate 63*c* is formed to be a recessed curved surface to face the outer circumferential surface of the development roller 62 via a gap having a predetermined interval (e.g., approximately 300 μm which is narrower than the gap formed at the development position DP between the development roller 62 and the photosensitive drum 3). Further, the lower end part of the collecting substrate 63*c* is located to carry downwardly the toner T.

The bottom carrying substrate 63*a* and the vertical carrying substrate 63*b* of the carrying substrate 63 are electrically connected to a carrying power supply circuit 64. The collecting substrate 63*c* is electrically connected to a collecting power supply circuit 65. The development roller 62 is electrically connected to a development bias power supply circuit 66.

Each of the carrying power supply circuit 64, the collecting power supply circuit 65 and the development bias power supply circuit 66 is configured to output an appropriate voltage required to circulate the toner T in the toner transport direction TTD along the toner transport path TTP (i.e., to carry the toner T in the toner reservoir 61*a* to be held on the development roller 62, to supply the toner T held on the development roller 62 to the development position DP, to collect the toner T which has not been consumed at the development position DP from the development roller 62, and to circulate downwardly the collected toner T to the toner reservoir 61*a*).

More specifically, the carrying power supply circuit 64 outputs an alternating voltage having a rectangular waveform, a voltage of 400V to 1000V (an amplitude of 600V and a DC offset of 700V) and a frequency of 300 Hz. The collecting power supply circuit 65 outputs an alternating voltage having a rectangular waveform, a voltage of −300V to +300V (an amplitude of 600V and a DC offset of 0V) and a frequency of 300 Hz. The development bias power supply circuit 66 outputs an alternating voltage having a rectangular waveform, a voltage of −600V to 1400V (an amplitude of 2000V and a DC offset of 400V) and a frequency of 1200 Hz.

That is, the development bias power supply circuit 66 applies, to the development roller 62, the output voltage (i.e., a collecting bias) having the amplitude larger than that of the collecting power supply circuit 65 and having the frequency which is an integral multiple of the frequency of the output voltage of the collecting power supply circuit 65. Furthermore, the collecting power supply circuit 65 applies, to the collecting substrate 63*c*, the output voltage having an average potential (0V) which is lower than an average potential (240V) of the exposed part on the electrostatic latent image holding surface LS to which the toner T is to be supplied. Furthermore, the output voltages of the collecting power supply circuit 65 and the development bias power supply circuit 66 are set such that the electric field between the development roller 62 and the collecting substrate 63*c* is stronger than the electric field between the development roller 62 and the photosensitive drum 3.

At a position close to the vertical carrying substrate 63*b* under the development roller 62 in the inner space of the toner box 61, a shield 67 is provided. The shield 67 is provided so that the toner T flying in the inner space of the toner box 61 due to the motion of the carrying substrate 63 is prevented from being adhered to the development roller 62.

Figure 3:
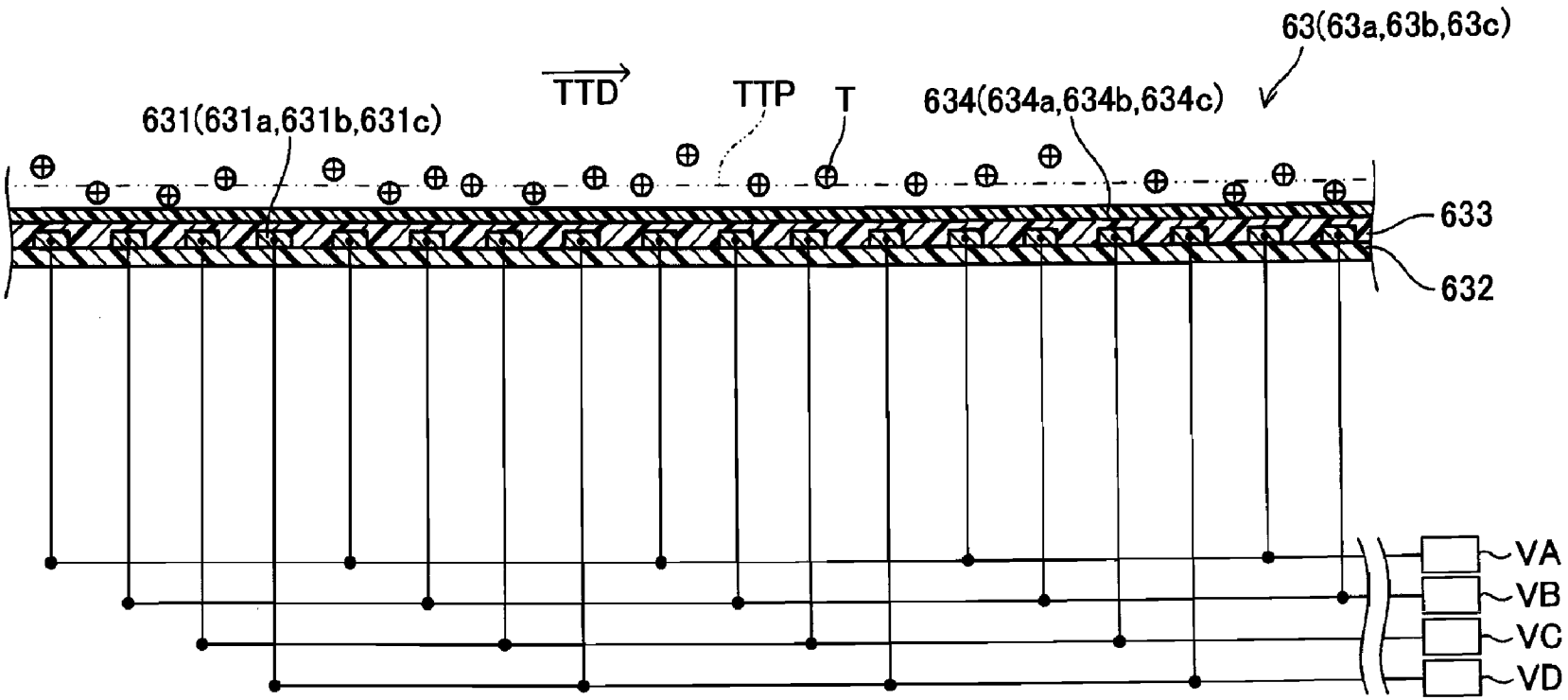
FIG. 3 is an enlarged side cross section of a carrying substrate.

As shown in FIG. 3, the carrying substrate 63 is a thin plate-like member. The carrying substrate 63 has a structure substantially equal to an FPC (Flexible Printed Circuit). More specifically, the carrying substrate 63 includes carrying electrodes 631, an electrode support film 632, an electrode coating 633 and an electrode overcoating 634.

Hereafter, the carrying electrodes 631 on the bottom carrying substrate 63*a*, the carrying electrodes 631 on the vertical carrying substrate 63*b*, the carrying electrodes 631 on the collecting substrate 63*c* are frequently referred to as bottom carrying electrodes 631*a*, vertical carrying electrodes 631*b* and collecting electrodes 631*c*, respectively. The carrying electrodes 631 are formed as linear patterns, each of which is elongated in parallel with the main scanning direction perpendicular to the auxiliary scanning direction and is formed of copper foil having a thickness of several tens of μm. The plurality of carrying electrodes 631 are aligned in parallel with each other and are arranged in the toner transport path TTP.

As shown in FIG. 3, the plurality of carrying electrodes 631 aligned along the toner transport path TTP are connected to power supply circuits VA, VB, VC and VD such that the carrying electrodes 631 are connected to the same power supply circuit at every four intervals. That is, the carrying electrode connected to the power supply circuit VA, the carrying electrode connected to the power supply circuit VB, the carrying electrode connected to the power supply circuit VC, the carrying electrode connected to the power supply circuit VD, the carrying electrode connected to the power supply circuit VA, the carrying electrode connected to the power supply circuit VB, the carrying electrode connected to the power supply circuit VC and the carrying electrode connected to the power supply circuit VD . . . are repeatedly arranged in this order along the toner transport path TTP. It should be noted that the power supply circuits VA, VB, VC and VD are provided in each of the carrying power supply circuit 64 and the collecting power supply circuit 65.

Figure 4:
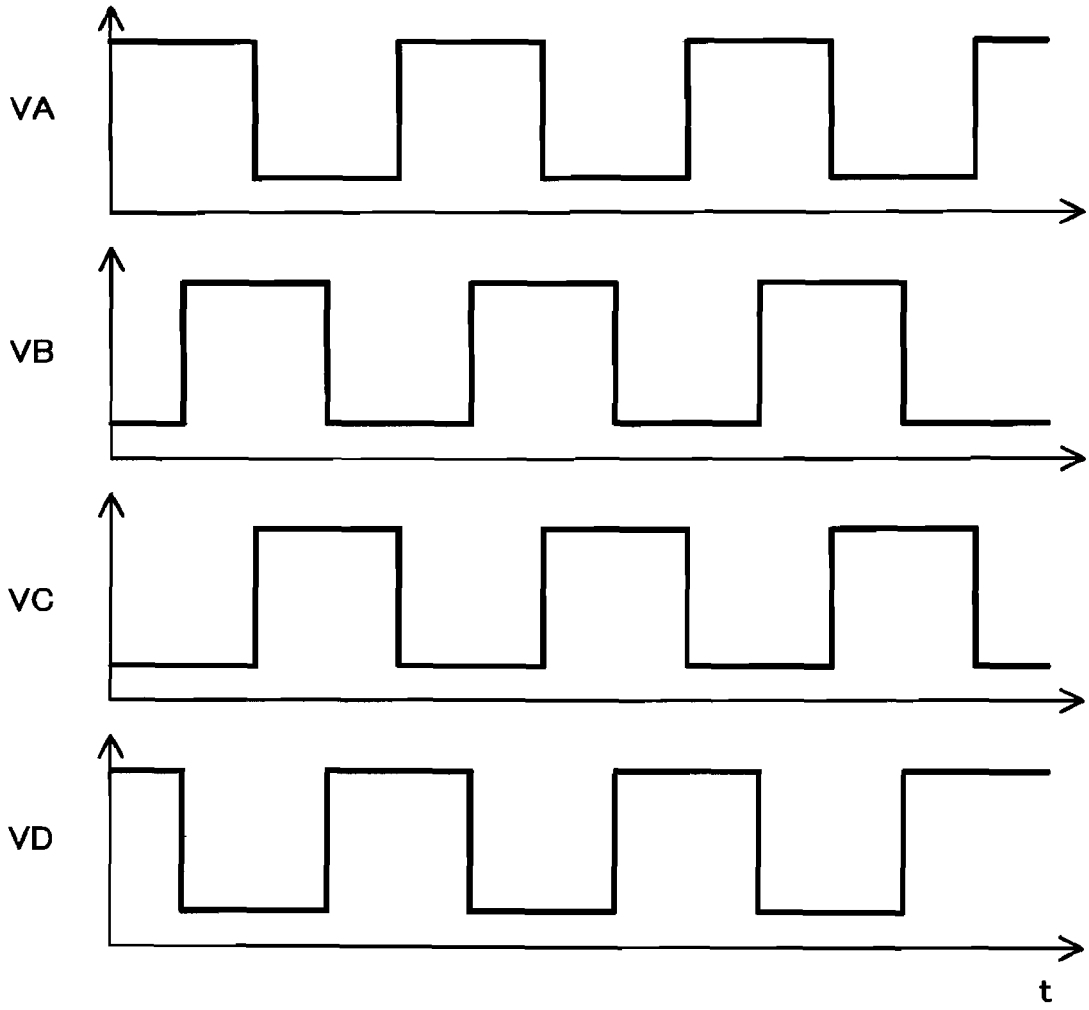
FIG. 4 is a timing chart illustrating waveforms of output signals of power supply circuits.

As shown in FIG. 4, the power supply circuits VA to VD output substantially the same driving voltages (i.e., alternating voltages). The phases of the output voltages of the power supply circuits VA to VD are shift with respect to each other by 90°. That is, in the order of the output signals of the power supply circuits VA to VD, each of the voltage phases of the output signals delays by 90°.

By applying the above described driving voltages to the carrying electrodes 631, the carrying substrate 63 generates a traveling electric field along the toner transport path TTP so that the positively charged toner T is carried in the toner transport direction TTD.

The plurality of carrying electrodes 631 are formed on the electrode support film 632. The electrode support film 632 is an elastic film, for example, made of insulating synthetic resin such as polyimide resin.

The electrode coating 633 is made of insulating synthetic resin. The electrode coating 633 is provided to cover the carrying electrodes 631 and a surface of the electrode support film 632 on which the carrying electrodes 631 are formed.

On the electrode coating 633, the electrode overcoating 634 is formed. Hereafter, the electrode overcoating 634 formed on the bottom carrying substrate 63*a*, the electrode overcoating 634 formed on the vertical carrying substrate 63*b* and the electrode overcoating 634 formed on the collecting substrate 63*c* are frequently referred to as a bottom overcoating 634*a*, a vertical overcoating 634*b*, a collecting overcoating 634*c*, respectively. That is, the electrode coating 633 is formed between the electrode overcoating 634 and the carrying electrodes 631. A surface of the electrode overcoating 634 is formed to be a smooth flat surface without bumps and dips so that the toner T can be carried smoothly.

In this embodiment, the vertical overcoating 634*b* and the collecting overcoating 634*c* are made of the same material (e.g., polyester). That is, as the material of the vertical overcoating 634*b* and the collecting overcoating 634*c*, material having a triboelectrification position on the plus side in the triboelectrification order with respect to the material (polyimide) of the bottom overcoating 634*a* is adopted. That is, the material of the vertical overcoating 634*b* and the collecting overcoating 634*c* has the same electrification polarity as that of the material of the toner T with respect to the material of the bottom overcoating 634*a*.

Hereafter, operations of the laser printer 1 are explained.

As shown in FIG. 1, the leading edge of the sheet of paper P placed on the paper supply tray (not shown) is carried to the registration roller 21. Then, skew of the sheet of paper P is corrected, and the carrying timing is adjusted. Thereafter, the sheet of paper P is carried to the transfer position TP.

While the sheet of paper P is carried to the transfer position TP, an image formed by the toner T is formed on the electrostatic latent image holding surface LS as described below.

The electrostatic latent image holding surface LS of the photosensitive drum 3 is charged by the charger 4 positively and uniformly. The electrostatic latent image holding surface LS charged by the charger 4 moves along the auxiliary scanning direction by rotation in the direction indicated by the arrow in FIG. 1 to reach the scan position SP facing the scanning unit 5.

At the scan position SP, the laser beam LB modulated by image information scans on the electrostatic latent image holding surface LS in the main scanning direction. In accordance with a modulated state of the laser beam LB, the positive charges of the electrostatic latent image holding surface LS are partially removed. As a result, a pattern of the positive charges (corresponding to an image to be formed) appears as an electrostatic latent image.

The electrostatic latent image formed on the electrostatic latent image holding surface LS moves to the development position DP facing the toner supply unit 6 by rotation of the photosensitive drum 3 in the direction indicated by the arrow in FIG. 1 (i.e., in the clockwise direction).

By comparing FIG. 2 with FIG. 3, it is understood that the toner T stored in the toner box 61 charges, for example, by contact and friction with respect to the bottom overcoating 634*a* of the bottom carrying substrate 63*a*. The charged toner T which contacts or is situated closely to the bottom overcoating 634*a* of the bottom carrying substrate 63*a* is carried in the toner transport direction TTD by the electric field generated by the voltage applied to the bottom carrying substrate 631*a*, and is passed to the vertical carrying substrate 63*b*.

In this embodiment, the downstream end portion of the bottom carrying substrate 63*a* along the toner transport direction TTD (i.e., a connection part of the bottom carrying substrate 63*a* with respect to the vertical carrying substrate 63*b*) is formed to be a curved surface. Consequently, it becomes possible to smoothly pass the toner T from the bottom carrying substrate 63*a* to the lower end portion of the vertical carrying substrate 63*b*.

The vertical carrying substrate 63*b* carries upward the toner T which has been passed at the lower end portion thereof from the bottom carrying substrate 63*a*. Since the vertical overcoating 634*b* of the vertical carrying substrate 63*b* has the lower degree of effect of further charging positively the toner T that that of the bottom overcoating 634*a* of the bottom carrying substrate 63*a*, it becomes possible to prevent the charged state of the toner T being carried along the vertical carrying substrate 63*b* from being altered.

It should be noted that toner not properly charged (e.g., toner charged negatively or non-charged toner) has been mixed into the toner T passed from the bottom carrying substrate 63*a*. However, due to gravity or an electric field generated between the vertical carrying substrate 63*b* and the development roller 62, the toner not properly charged falls downward when the toner T is carried upward in the vertical direction along the vertical carrying substrate 63*b* or when the toner T is attracted toward the development roller 62 by the electric field acting between the vertical carrying substrate 63*b* and the development roller 62.

With this configuration, only the toner T in a suitably charged state can be selectively supplied to the development roller 62 and the development position DP. That is, on the vertical carrying substrate 63*b*, the toner not properly charged is separated from the toner T suitably charged.

The toner which has fallen downward from the vertical carrying substrate 63*b* reaches the downstream side end of the bottom carrying substrate 63*a* along the toner transport direction TTD. In this case, the toner T situated around the downstream side end of the bottom carrying substrate 63*a* along the toner transport direction TTD is suitably fluidized, and therefore is suitably charged by friction with the bottom overcoating 634*a*.

As described above, in the toner supply unit 6, the toner T can be suitably carried without the need for forcibly charging the toner T in the toner reservoir 61*a* through the mechanical effect by a stirring member such as a blade. Therefore, deterioration with time of the toner can be suppressed.

The toner which is not properly charged and has fallen from the vertical carrying substrate 63*b* reaches directly to the toner reservoir 61*a*, but not the midway of the vertical carrying substrate 63*b*. Therefore, it becomes possible to prevent the flow of the toner T by the vertical carrying substrate 63*b* from being disturbed. For example, removal of the suitably charged toner T from the vertical carrying substrate 63*b*, and retention and deposition of the not properly charged toner T on the vertical carrying substrate 63*b* can be prevented.

The positively charged toner T is thus supplied to the development position DP. In the vicinity of the development position DP, the electrostatic latent image formed on the electrostatic latent image holding surface LS is developed with the toner T. That is, the toner T adheres to a part of the electrostatic latent image holding surface LS where positive charges of the electrostatic latent image are removed. As a result, an image formed by the toner T (hereafter, referred to as a toner image) is held on the electrostatic latent image holding surface LS.

The toner T which is held on the toner holding surface 62*a* and has passed the development position DP (i.e., the toner T which has not consumed at the development position DP) moves to the side of the collecting substrate 63*c* by the effect of the collecting bias. That is, the toner T not consumed at the development position DP is collected from the toner holding surface 62*a* by the collecting substrate 63*c*.

In this embodiment, an alternating bias is applied to the development roller 62. By the effect of an alternating component of the collecting bias, the toner T adjacent to the toner holding surface 62*a* of the development roller 62 vibrates. By such vibration of the toner T, the toner T raised from the toner holding surface 62*a* collides with the toner T adhered to the toner holding surface 62*a*. As a result, the toner T adhered to the toner holding surface 62*a* is brought to a state where the toner T can be easily raised from the toner holding surface 62*a*.

In this embodiment, the average potential (0V) of the collecting bias is lower than the potential (240V) of the exposed part which is formed on the electrostatic latent image holding surface LS and to which the toner T is to be supplied. Furthermore, in this embodiment, the electric field between the development roller 62 and the collecting substrate 63*c* is stronger than the electric field between the development roller 62 and the photosensitive drum 3.

Therefore, the toner T which has not been consumed at the development position DP is adequately removed from the toner holding surface 62*a* and is moved to the side of the collecting substrate 63*c*. Consequently, it becomes possible to appropriately prevent a ghost image from occurring on a formed image.

Furthermore, in this embodiment, the amplitude of the collecting bias is larger than the amplitude of the voltage applied to the collecting electrodes 631*c*. Therefore, it is possible to suitably collect the toner T from the toner holding surface 62*a* without increasing the voltage between adjacent ones of the collecting electrodes 631*c*. That is, it is possible to suitably maintain insulation between adjacent ones of the collecting electrodes 631*c*.

In addition to the above described function of the collecting bias, the collecting bias also serves as a bias for a so-called jumping phenomenon at the development position DP. In other words, the collecting bias can be suitably applied with a relatively simple structure.

The toner T moved from the toner holding surface 62*a* to the side of the collecting substrate 63*c* is carried to the downwardly located ink reservoir 61*a* by the electric field generated by the voltage applied to the collecting electrodes 631*c*.

In this embodiment, the frequency of the collecting bias is set to an integral multiple of the frequency of the voltage applied to the vertical carrying electrodes 631*b* or the collecting electrodes 631*c*. Therefore, the electric field of the collecting bias and the electric field for carrying the toner T along the collecting substrate 63*c* can be suitably synchronized with respect to each other.

At the lower end portion of the collecting substrate 63*c*, the toner T is carried downwardly in the vertical direction. In this case, the inertia having the same direction as that of gravity acts on the toner T. Further, in a downward portion with respect to the downward end of the collecting substrate 63*c*, the toner T falls toward the toner reservoir 61*a* by the effect of the gravity and the inertia having the same direction as that of the gravity. Therefore, the toner T suitably circulates to the toner reservoir 61*a* even when the collecting substrate 63*c* is not formed to reach the toner reservoir 61*a*.

As shown in FIG. 1, the toner image held on the electrostatic latent image holding surface LS is carried to the transfer position TP by rotation of the electrostatic latent image holding surface LS in the direction indicated by the arrow (i.e., in the clockwise direction). At the transfer position TP, the toner image is transferred to the sheet of paper P.

Second Embodiment

Figure 5:
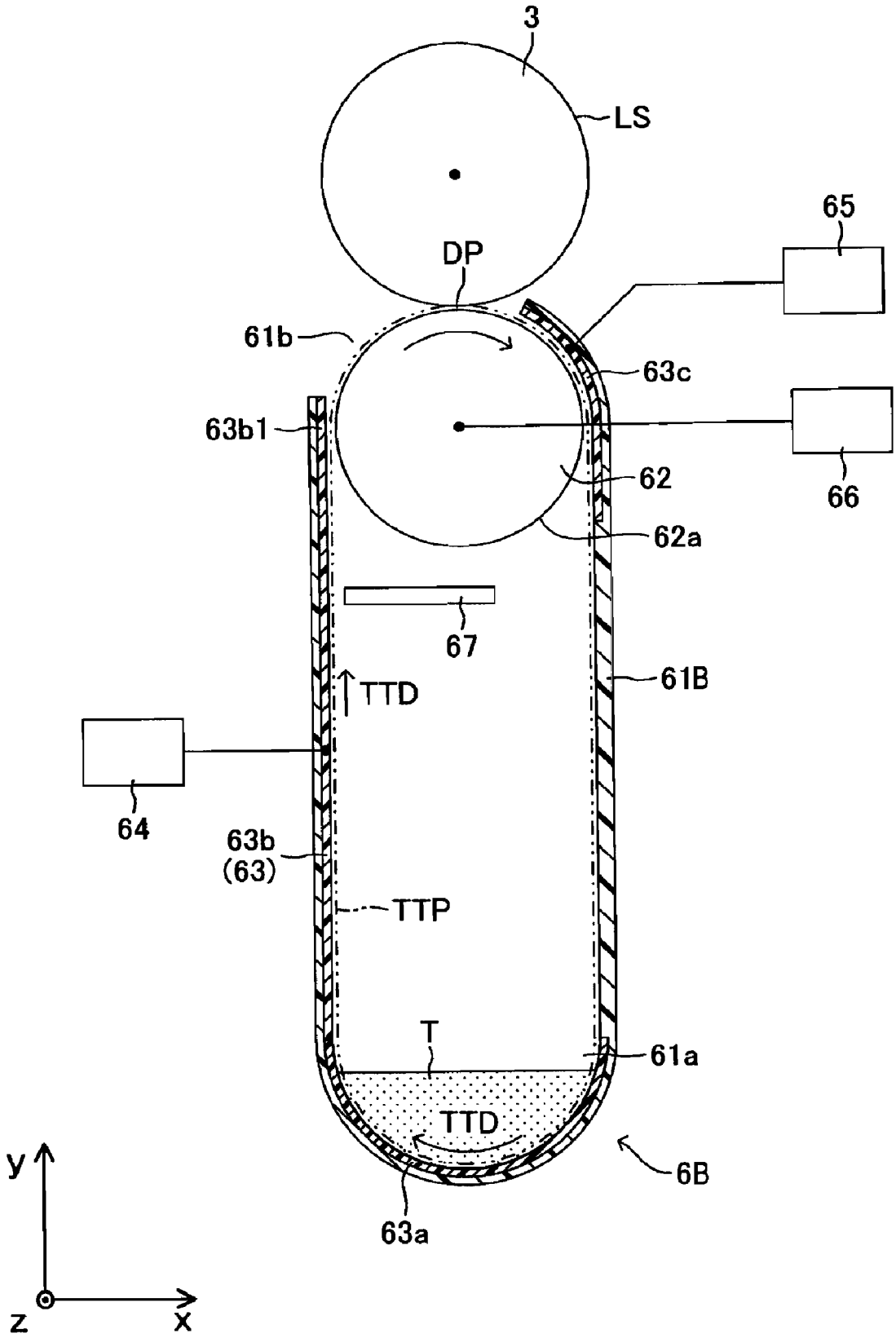
FIG. 5 is an enlarged side cross section of a toner supply unit according to a second embodiment.
Figure 6:
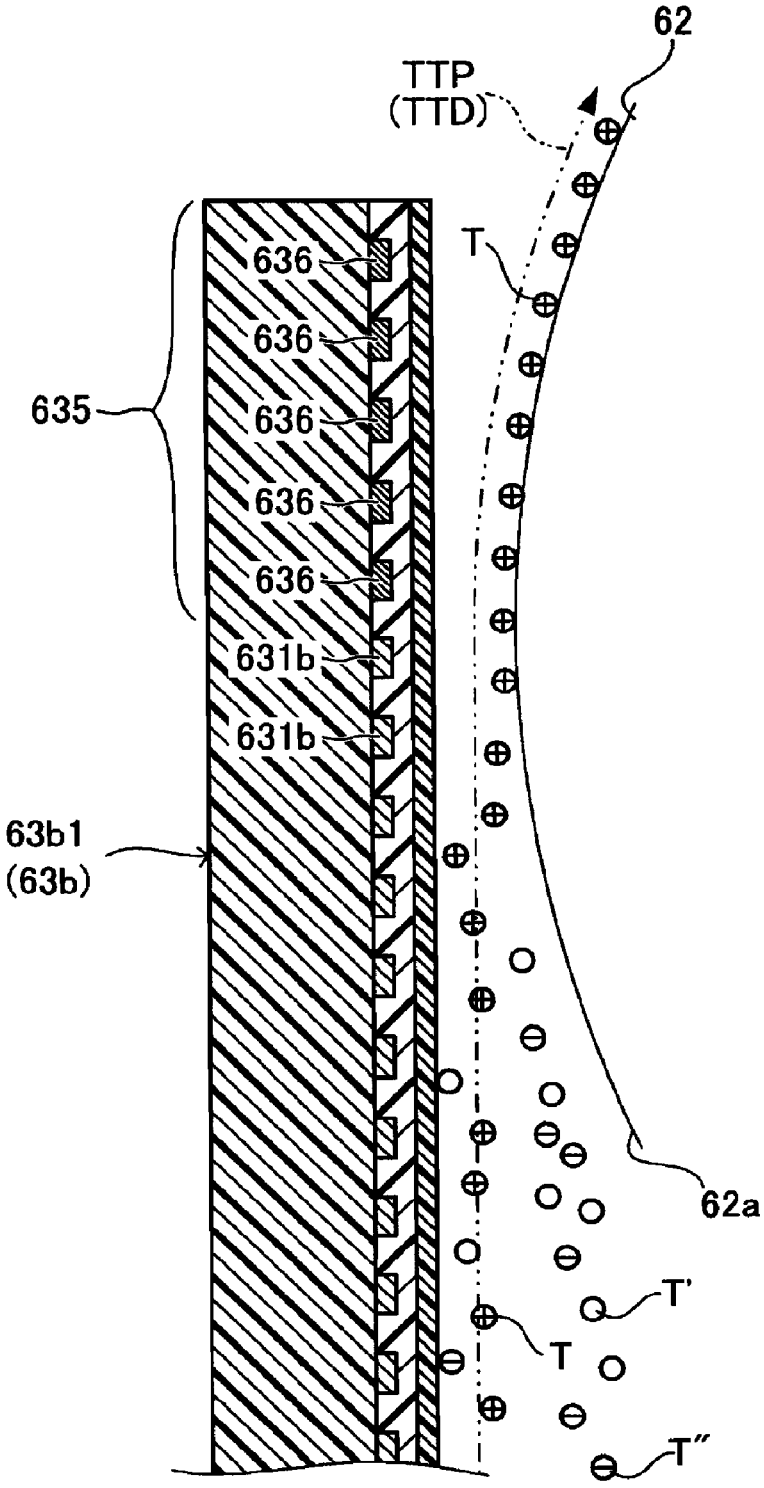
FIG. 6 is an enlarged side cross section around an upper end portion of a vertical carrying substrate of the toner supply unit shown in FIG. 5.

Hereafter, a second embodiment is described. Since a toner supply unit 6B of the second embodiment is a variation of the toner supply unit 6 of the first embodiment and a laser printer according to the second embodiment has substantially the same configuration as that shown in FIG. 1, the following explanation focuses on features of the second embodiment. In FIGS. 5 and 6, to elements which are substantially the same as those of the first embodiment, the same reference numbers are assigned, and explanations thereof will not be repeated.

As shown in FIG. 5, an upper end part 63*b*1 of the vertical carrying substrate 63*b* is situated at the position substantially equal to the height of the center of the development roller 62.

As shown in FIG. 6, at the uppermost part of the upper end part 63*b*1 in the toner transport direction TTD, a carry stop area 635 is provided. In this embodiment, the carry stop area 635 is formed in an area from the uppermost end of the vertical carrying substrate 63*b* to the position at which the vertical carrying substrate 63*b* is closest to the toner holding surface 62*a*. The carry stop area 635 is configured not to generate the electric field for carrying the toner T in the toner transport direction TTD.

More specifically, in the carry stop area 635, a plurality of carry stop electrodes 636 are provided. That is, parts of the electrodes 631*b* formed at the downstream end portion on the vertical carrying substrate 63*b* are used as the carry stop electrodes 636. Therefore, the carry stop electrodes 636 are provided along the toner transport path TTP. Each of the carry stop electrodes 636 is formed as a liner pattern elongated in parallel with the main scanning direction, and is formed of copper foil having a thickness of several tens of μm.

To the carry stop electrodes 636, a polyphase alternating voltage having the inverse traveling direction with respect to the traveling direction of the voltage for the carrying electrodes 631 shown in FIG. 4 is applied. That is, the carry stop area 635 has the function of carrying the toner T in the inverse direction of the toner transport direction TTD.

As shown in FIG. 6, in the toner T being carried on the vertical carrying substrate 63*b*, toner not properly charged (e.g., non-charged toner T' and inversely charged (negatively charged) toner T") is mixed. However, as explained below, only toner T properly charged can be supplied to the toner holding surface 62*a* of the development roller 62.

While the toner T is carried upward in the vertical direction on the vertical carrying substrate 63*b*, the non-charged toner T' falls downward from the vertical carrying substrate 63*b* by the effect of gravity. The negatively charged toner T" also falls downward by the effect of the bias between the vertical carrying substrate 62*b* and the development roller 62, the electric field generated on the carry stop area 635, and the effect of gravity.

As a result, only the toner T suitably charged is selectively supplied to the development roller 62 and the development position DP. That is, on the vertical carrying substrate 63*b*, the toner not properly charged is separated from the toner T suitably charged.

It should be understood that the same advantages as those of the first embodiment are also be achieved by the second embodiment.

According to the embodiments, when Dh denotes a distance between a developer holding body (the development roller 62) and the collecting substrate 63*c*, and Dg denotes a distance between the developer holding body (the development roller 62) and the supply target (the photosensitive drum), the developer supply device satisfies a following relationship:

$$Dg>Dh.$$

When the developer has a positive electrostatic property, Vh denotes an average potential of the plurality of collecting electrodes, and VL denotes a potential of a part on the supply target to which the developer is to be supplied, the developer supply device satisfies a following relationship:

$$VL>Vh.$$

Although the present invention has been described in considerable detail with reference to certain preferred embodiments thereof, other embodiments are possible.

(1) Application of the above described embodiment is not limited to a monochrome laser printer. For example, the above described embodiment may be applied to various types of electrophotographic printers, such as a color laser printer and a monochrome or color copying device. In such a case, the shape of a photosensitive body is not limited to the drum shape described in the embodiment. For example, a flat plate type or endless belt type photosensitive body may be employed.

Various types of light sources for exposing other than the laser scanning unit may be employed. For example, LED, EL (electroluminescence) device or a fluorescent element may be employed.

The above described embodiment may also be applied to an image forming device which is not the electrophotographic type image forming device. For example, the above described embodiment may be applied to a toner jet type device, an ion flow type device and a multi-stylus type device which do not use a photosensitive body.

(2) The main part of the vertical carrying substrate 63*b* (i.e., a flat plate-like part excepting the upper end portion of the vertical carrying substrate 63*b*) may be formed to stand substantially in the vertical direction. That is, the vertical carrying substrate 63*b* may be inclined to some extent. Similarly, the collecting substrate 63*c* may be inclined to some extent.

(3) The central part of the bottom carrying substrate 63*a* may be formed to be a flat shape. That is, only the connection part of the bottom carrying substrate 63*a* connected to the lower end of the vertical carrying substrate 63*b* may be formed as the curved surface part.

(4) The downstream end of the collecting substrate 63*c* in the toner transport direction TTD may be connected to the bottom carrying substrate 63*a*.

(5) The shield 67 may be omitted.

(6) The configuration of the carrying substrate 63 is not limited to that shown in the above described embodiment. For example, the electrode overcoating 634 may be omitted. In this case, the material of the electrode coating 633 may be selected as in the case of the electrode coating 634. Alternatively, by burying the carrying electrodes 631 in the electrode support film 632, the electrode coating 633 and the electrode overcoating 634 can be omitted.

(7) The waveforms of the output voltages of the power supply circuits VA to VD are not limited to the rectangular shape shown in FIG. 4. For example, sine waveforms or triangular waveforms may be employed as output voltages of the power supply circuits VA to VD.

In the above described embodiment, four power supply circuits VA to VD are provided, and phases of the output voltages of the power supply circuits VA to VD are shift by 90° with respect to each other. However, the embodiment is not limited to such a structure. For example, in another embodiment, three power supply circuits may be employed, and in this case phases of output voltages of the three power supply circuits may shift by 120° with respect to each other.

(8) The applied voltage to the development roller 62 may include only a DC component (including a ground level).

(9) The photosensitive drum 3 may contact the development roller 62.

(10) The potential of the carry stop electrodes 636 may be fixed. In this case, only one carrying electrode may be provided in the carry stop area 635.

What is claimed is:

1. A developer supply device carrying charged developer along a developer carrying path to a supply target, comprising:

a carrying substrate that includes a plurality of carrying electrodes arranged along the developer carrying path and is configured to carry the developer through an electric field generated by voltage application to the plurality of carrying electrodes; and a developer reservoir part accommodating the developer, wherein:

the carrying substrate comprises a vertical carrying substrate provided to stand to carry the developer upward in a substantially vertical direction; and the developer is supplied to the supply target around an upper end portion of the vertical carrying substrate, and the carrying substrate further comprises a bottom carrying substrate that forms a bottom part of the developer reservoir part and is connected to a lower end part of the vertical carrying substrate so as to charge the developer by friction with the developer and to carry the developer to the lower end part of the vertical carrying substrate.

2. The developer supply device according to claim 1, wherein a connection part of the bottom carrying substrate with respect to the vertical carrying substrate is formed as a curved surface.

3. The developer supply device according to claim 1, wherein a material forming a surface of the vertical carrying substrate has the same electrification polarity as that of the developer with respect to a material forming a surface of the bottom carrying substrate.

4. The developer supply device according to claim 1, further comprising a developer holding body that has a form of a roller having a cylindrical outer circumferential surface and is provided to face the supply target and the upper end portion of the vertical carrying substrate.

5. The developer supply device according to claim 4, further comprising a bias supply unit configured to apply a bias between the vertical carrying substrate and the developer holding body to generate an electric field through which the developer moves from the upper end portion of the vertical carrying substrate to the developer holding body.

6. The developer supply device according to claim 5, wherein at an uppermost end of the vertical carrying substrate, a carry stop area configured not to generate an electric field for carrying the developer in a developer carrying direction is provided.

7. The developer supply device according to claim 6, wherein the carry stop area includes an inverse carrying portion configured to generate an electric field to carry the developer downward.

8. The developer supply device according to claim 6, wherein the carry stop area includes a carry stop electrode of which potential is fixed.

9. The developer supply device according to claim 7, wherein the inverse carrying portion includes a plurality of carry stop electrodes to which a polyphase alternating voltage having a traveling direction opposite to a traveling direction of a polyphase alternating voltage applied to the plurality of carrying electrodes is applied to carry the developer downward.

10. The developer supply device according to claim 4, further comprising:

a collecting substrate provided to face the developer holding body at a position opposite to a position of the upper end portion of the vertical carrying substrate with respect to the developer holding body, wherein:

the collecting substrate includes a plurality of collecting electrodes arranged along the developer carrying path; and the collecting substrate carries the developer downward through an electric field generated by voltage application to the plurality of collecting electrodes, and circulates the developer toward the developer reservoir part.

11. The developer supply device according to claim 10, wherein the collecting substrate is provided such that the developer is carried downward in a vertical direction at a lower end of the collecting substrate.

12. The developer supply device according to claim 10, wherein an alternating collecting bias is applied to the developer holding body.

13. The developer supply device according to claim 12, wherein an amplitude of the alternating collecting bias is larger than an amplitude of an voltage applied to the plurality of collecting electrodes.

14. The developer supply device according to claim 13, wherein a frequency of the alternating collecting bias is an integral multiple of a frequency of the voltage applied to the plurality of carrying electrodes.

15. The developer supply device according to claim 10, wherein an electric field between the developer holding body and the collecting substrate is stronger than an electric field between the developer holding body and the supply target.

16. The developer supply device according to claim 15, wherein when Dh denotes a distance between the developer holding body and the collecting substrate and Dg denotes a distance between the developer holding body and the supply target, the developer supply device satisfies a following relationship: $Dg>Dh$.

17. The developer supply device according to claim 15, wherein when the developer has a positive electrostatic property, Vh denotes an average potential of the plurality of collecting electrodes, and VL denotes a potential of a part on the supply target to which the developer is to be supplied, the developer supply device satisfies a following relationship: $VL>Vh$.

* * * * *